US006135880A

United States Patent [19]

Ho et al.

[11] Patent Number: 6,135,880

[45] Date of Patent: Oct. 24, 2000

[54] ADJUSTABLE REGISTER INCORPORATING A TOGGLE-JOINT MECHANISM TO MOVE SLATS THEREOF BETWEEN OPEN AND CLOSED POSITIONS

[75] Inventors: Tien-Hou Joseph Ho, 2336 Glenstone Ave., Hacienda Heights, Calif. 91745; Jiun-Jong Lee, Ping-Dong, Taiwan

[73] Assignee: Tien-Hou Joseph Ho, Hacienda Heights, Calif.

[21] Appl. No.: 09/354,249

[22] Filed: Jul. 15, 1999

[51] Int. Cl.[7] ..... F24F 7/00

[52] U.S. Cl. ..... 454/325; 454/335

[58] Field of Search ..... 454/275, 277, 454/280, 325, 290, 335

[56] References Cited

U.S. PATENT DOCUMENTS 4,550,648 11/1985 Eagle ..... 454/275
4,911,066 3/1990 Carew ..... 454/277
4,958,555 9/1990 Lentz et al. ..... 454/277
5,833,134 11/1998 Ho et al. .

*Primary Examiner*—Harold Joyce
*Assistant Examiner*—Derek S. Boles
*Attorney, Agent, or Firm*—Ladas & Parry

[57] ABSTRACT

An adjustable register includes a frame member having an air passage therethrough, a plurality of slats connected pivotally to the frame member, a slat connecting member connected to each of the slate a slat-controlling linkage connected pivotally to one of the slats, a toggle-joint mechanism connected pivotally to the slat-controlling linkage on the frame member, and a plurality of blocking bars on the frame member. As the toggle-joint mechanism is operated, the slat-controlling linkage is driven to drive one of the slats. All slats move concurrently between a closed position where the slats contact closely the blocking bars, and an open position where the slats allow air flow through the air passage. In the closed position, the air-tight effect of the register is ensured.

21 Claims, 11 Drawing Sheets

ADJUSTABLE REGISTER INCORPORATING A TOGGLE-JOINT MECHANISM TO MOVE SLATS THEREOF BETWEEN OPEN AND CLOSED POSITIONS

BACKGROUND OF THE INVENTION

1. Field of the Invention

The present invention relates to a register for use with a heating-ventilation and air-conditioning (HVAC) unit, more particularly to one with a manually adjustable toggle-joint mechanism to easily and precisely control airflow therethrough.

2. Description of the Related Art

It is known in the art that a central heating ventilating and air conditioning (HVAC) system incorporates a plurality of registers. The heating/conditioning air supplied by the HVAC unit is delivered into one or more zones of a house or a building through a plurality of air ducts by means of air pumps and into the zones via the plurality of registers installed at the ends of the air ducts. Two types of registers are commonly used: an air vent providing a constant amount of air flow, and an adjustable register providing a varied amount of air flow. Generally, in case that temperature control for individual zones is not required, the air supplied by the HVAC unit is constantly delivered into the zones via air vents and all zones are supplied with heating/conditioning air. In case the temperature control for individual zones is required, adjustable air registers are needed to meet this demand. When a zone is not occupied by people and thus heating/conditioning air is not needed, the adjustable register(s) installed therein can be shut off to block air flow so as to save energy. However, the presently available registers, though being capable of minimizing air flow therethrough, fail to effectively and completely block the same. As such, the goal of energy conservation is not satisfactorily realized.

FIGS. 1 to 3 illustrate a conventional adjustable register. The adjustable register 1 includes a rectangular hollow frame 2, a plurality of parallel slats 4, and a slat-adjusting assembly 6 including a connecting linkage 8 and an operating lever 10. The front end of the frame 2 is provided with a louvered structure 14 having a plurality of air passages 16 through which the air heating/conditioning air supplied by the HVAC unit (not shown in the drawings) can be delivered into a zone where the register 1 is installed. As clearly shown in FIG. 2, the frame 2 has two side mounting walls 18 that extend rearwardly. Each of the parallel slats 4 (three slats 4 are shown in the drawings) has two opposing pivoting ends pivotally mounted on the side mounting walls 18, respectively, at a first pivot portion 19. Aside from being pivotally connected to the respective one of the side mounting walls 18, one of the pivoting ends of each of the slats 4 is also pivotally mounted on the connecting linkage 8 of the slat-adjusting assembly 6 at a second pivot portion 20. The second pivot portion 20 of each of the slats 4 is spaced apart from the first pivot portion 19. One end of the operating lever 10 adjacent to the connecting linkage 8 is formed with a guiding slot 22, where the second pivot portion 20 of the middle one of the slats 4 is located and movably guided. The operating lever 10 has a distal operating end 28 remote from the guiding slot 22, which extends forwardly through a slot 24 formed in the frame 2 and parallel to the side mounting walls 18. The operating lever 10 is pivotally mounted on one of the side mounting walls 18 adjacent to the connecting linkage 8 at a pivot center 26 which is located between the operating end 28 and the guiding slot 22. The slot 24 is of sufficient length so that the operating end 28 of the operating lever 10 can be operated to move upward and downward within a predetermined range.

As the operating lever 10 pivots, the second pivot portion 20 of the middle one of the slats 4 is driven to move along the length of the guiding slot 22. Such a movement results in the movement of the connecting linkage 8, which in turn causes the slats 4 connected thereto to pivot about a pivot axis extending through the two opposing first pivot portions 19 of each of the slats 4. As a result, the slats 4 are pivoted between a closed position where the slats 4 overlap the longitudinal edges of the adjacent slats 4 or the frame 2 to cover the air passages 16, and an open position where the air passages 16 are not blocked to allow air flow therethrough.

The above-mentioned construction, however, is functionally incomplete in some aspects. For example, the blocking effect is not satisfactorily achieved. When in the closed position, the slats 4 fail to contact tightly the frame 2 or the adjacent slats 4, thereby allowing air to easily leak through the clearances between adjacent two of the slats 4 and between the lowermost slat 4 and the frame 2, as indicated by (A) in FIG. 3. Besides, the slot 24 where the operating lever 10 extends also serves as an air leaking passage, as indicated by (B) in FIG. 3. Therefore, air-tight effect is unlikely to be achieved in the conventional register 1, and energy is wasted.

SUMMARY OF THE INVENTION

In view of the above-mentioned disadvantage, it would be desirable and advantageous to provide a register which is easy to manually operate and which can provide complete air-tight performance, thus effectively achieving the goal of energy conservation.

Therefore, an object of the present invention is to provide an adjustable register which can precisely control the air flow therethrough.

Another object of this invention is to provide an adjustable register which incorporates a pressing mechanism for airtight block of air flow therethrough, thus easily accomplishing the goal of energy saving.

A further object of this invention is to provide an adjustable register which incorporates a toggle-joint mechanism for easily controlling the opening and closing of the air passage of the register.

Still another object of this invention is to provide an adjustable register which has a simple design and which can be produced at a relatively low cost.

Yet another object of this invention is to provide an adjustable register which is durable and easily manually operated.

Accordingly, the register of this invention comprises: a hollow frame member including opposite lateral frame portions and opposite transverse frame portions that bridge the lateral frame portions, the frame member having open front and rear sides, and an air passage extending from the rear side through the front side; a plurality of elongated slats, each of which has opposite ends mounted pivotally and respectively on the lateral frame portions of the frame member, the slats being movable between an open position, where the slats permit airflow through the air passage, and a closed position, where the slats block airflow through the air passage; a slat connecting member connected pivotally to each of the slats such that movement of a driven one of the slats results in corresponding movement of other ones of the slats between the open and closed positions; a plurality of elongated blocking bars mounted securely on and extending between the lateral frame portions of the frame member, the blocking bars being disposed so as to abut against longitudinal edges of the slats when the slats are in the closed position to block clearances formed between endmost ones of the slats and the transverse frame portions of the frame member and between the longitudinal edges of adjacent ones of the slats; an operating lever having an operating end portion and a mounting end portion opposite to the operating end portion and connected movably to the frame member; and a slat controlling linkage connected pivotally to the mounting end portion of the operating lever, and further connected to the driven one of the slats; the operating end of the operating lever being operable to move the operating lever and the slat controlling linkage, thereby moving the driven one of the slats to result in the corresponding movement of the other ones of the slats between the open and closed positions.

BRIEF DESCRIPTION OF THE DRAWINGS

The features and advantages of the present invention will be described in more detail with reference to the accompanying drawings which illustrate the preferred embodiment of this invention, wherein.

DETAILED DESCRIPTION OF THE PREFERRED EMBODIMENT

Figure 1:
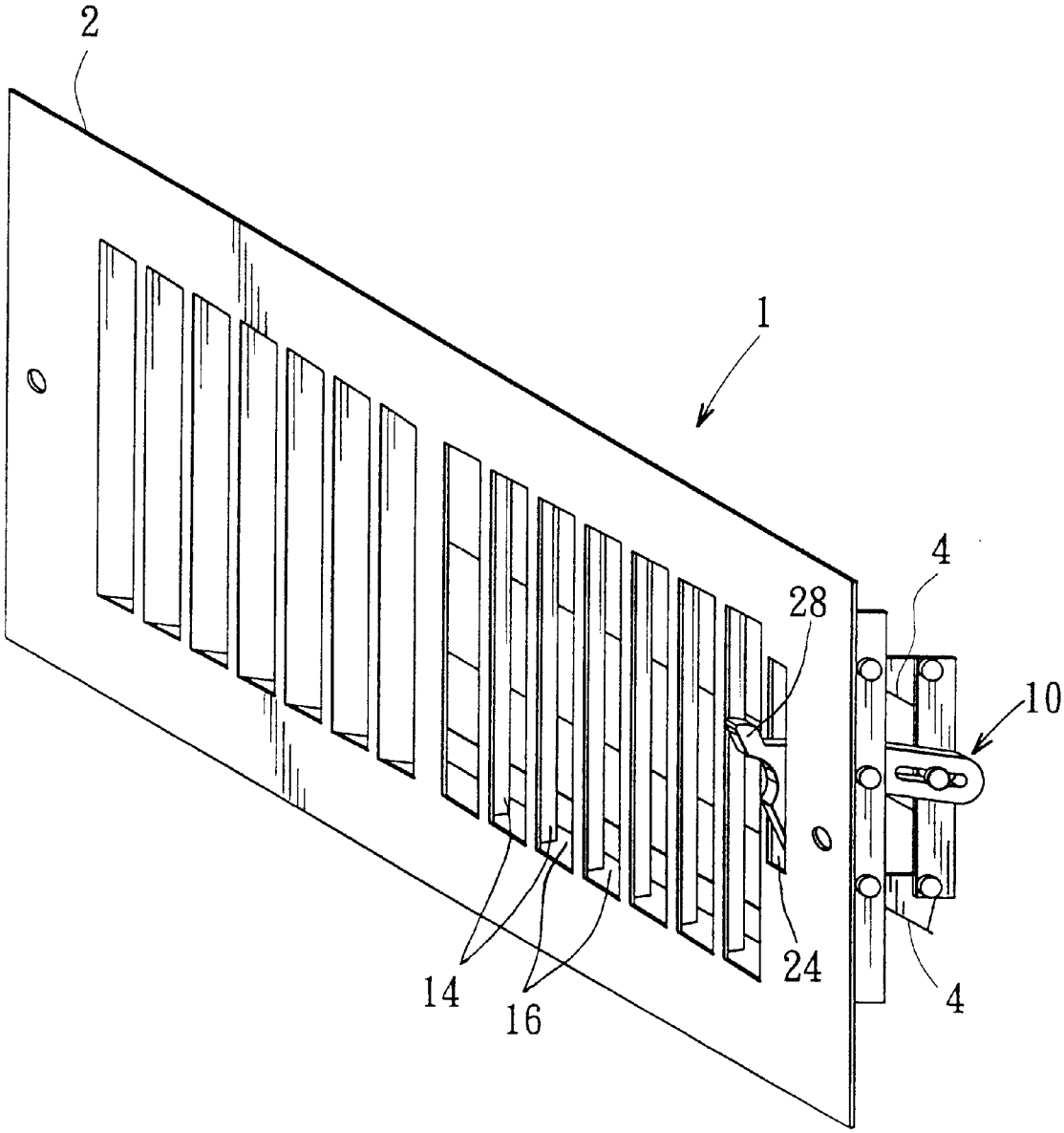
FIG. 1 PRIOR ART
FIG. 1 is a front perspective view of a conventional register.
Figure 2:
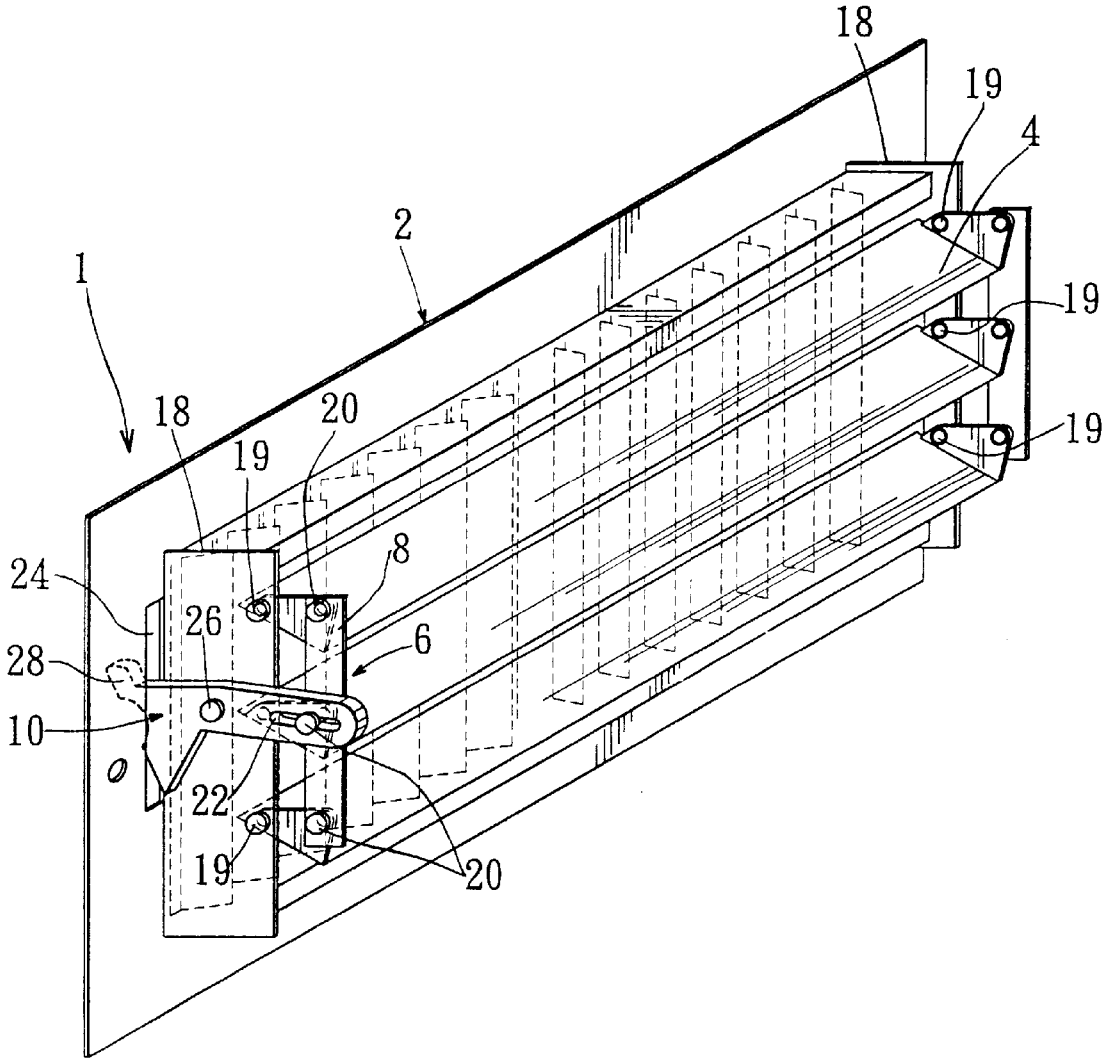
FIG. 2 PRIOR ART
FIG. 2 is a rear perspective view of the conventional register of FIG. 1.
Figure 3:
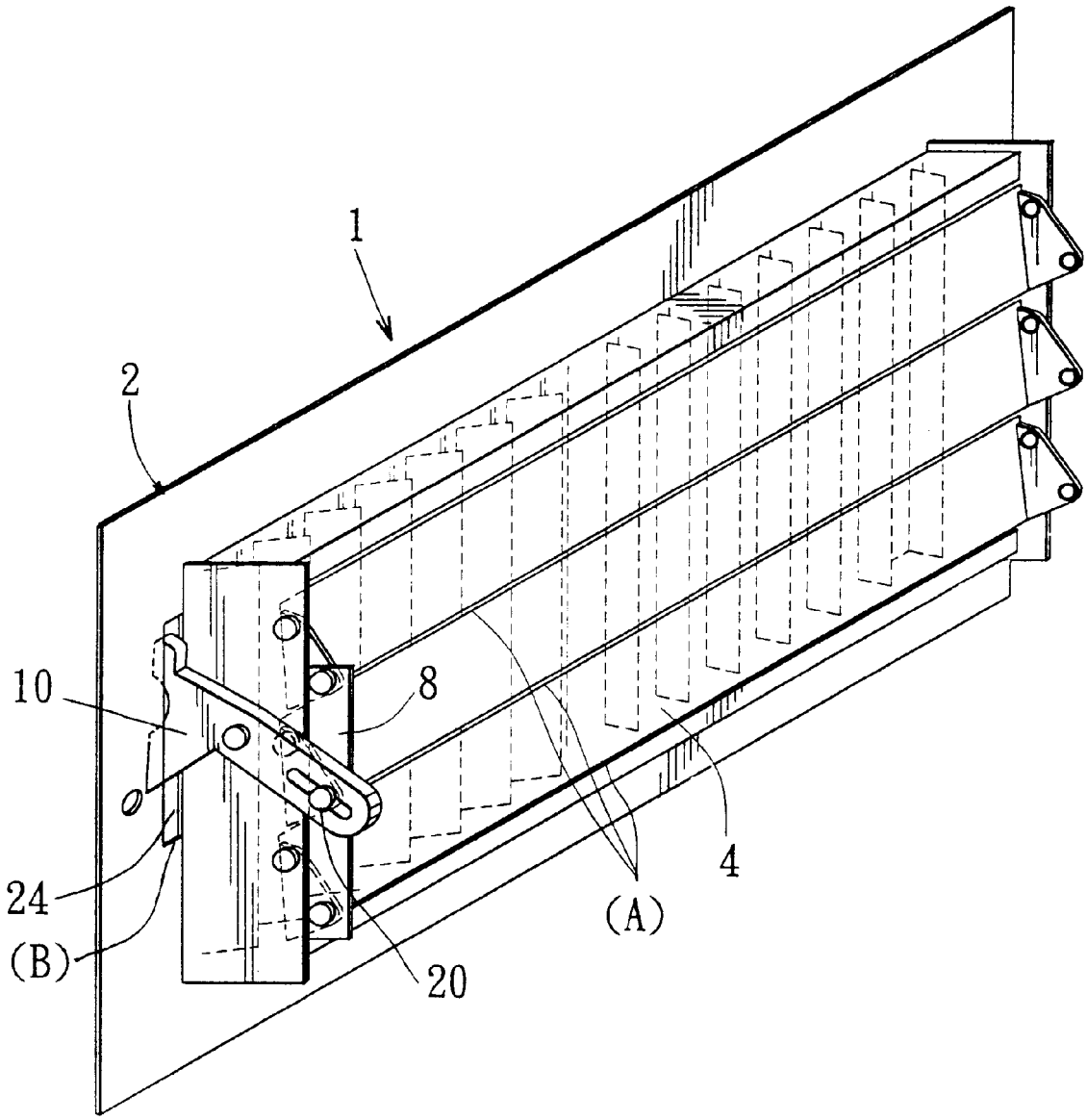
FIG. 3 PRIOR ART
FIG. 3 is another rear perspective view of the conventional register of FIG. 2, with the slats in the closed position.
Figure 4:
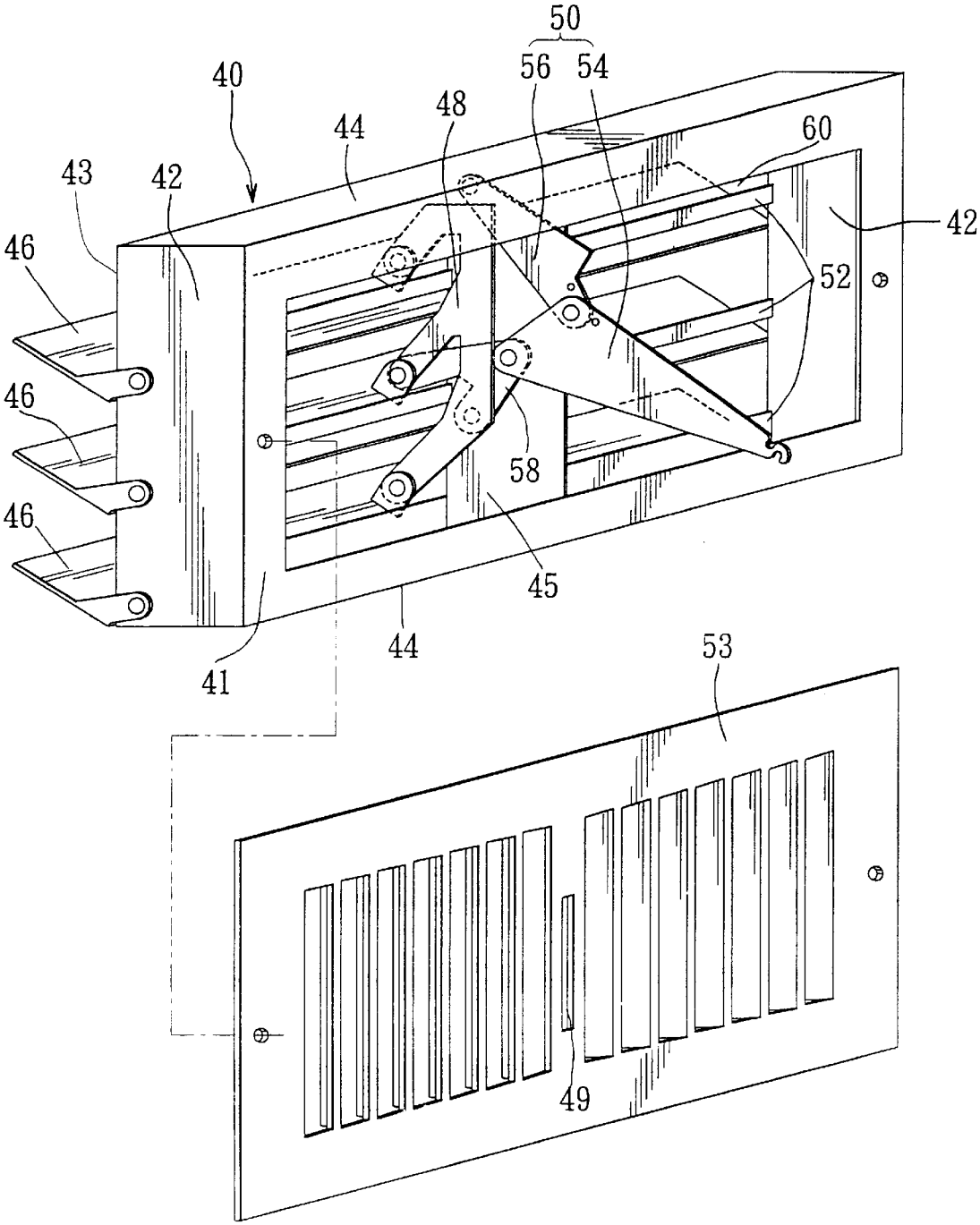
FIG. 4 is a front perspective view of a preferred embodiment of an adjustable register of this invention, wherein the front louvered register face panel is removed from the frame member for clarity.
Figure 5:
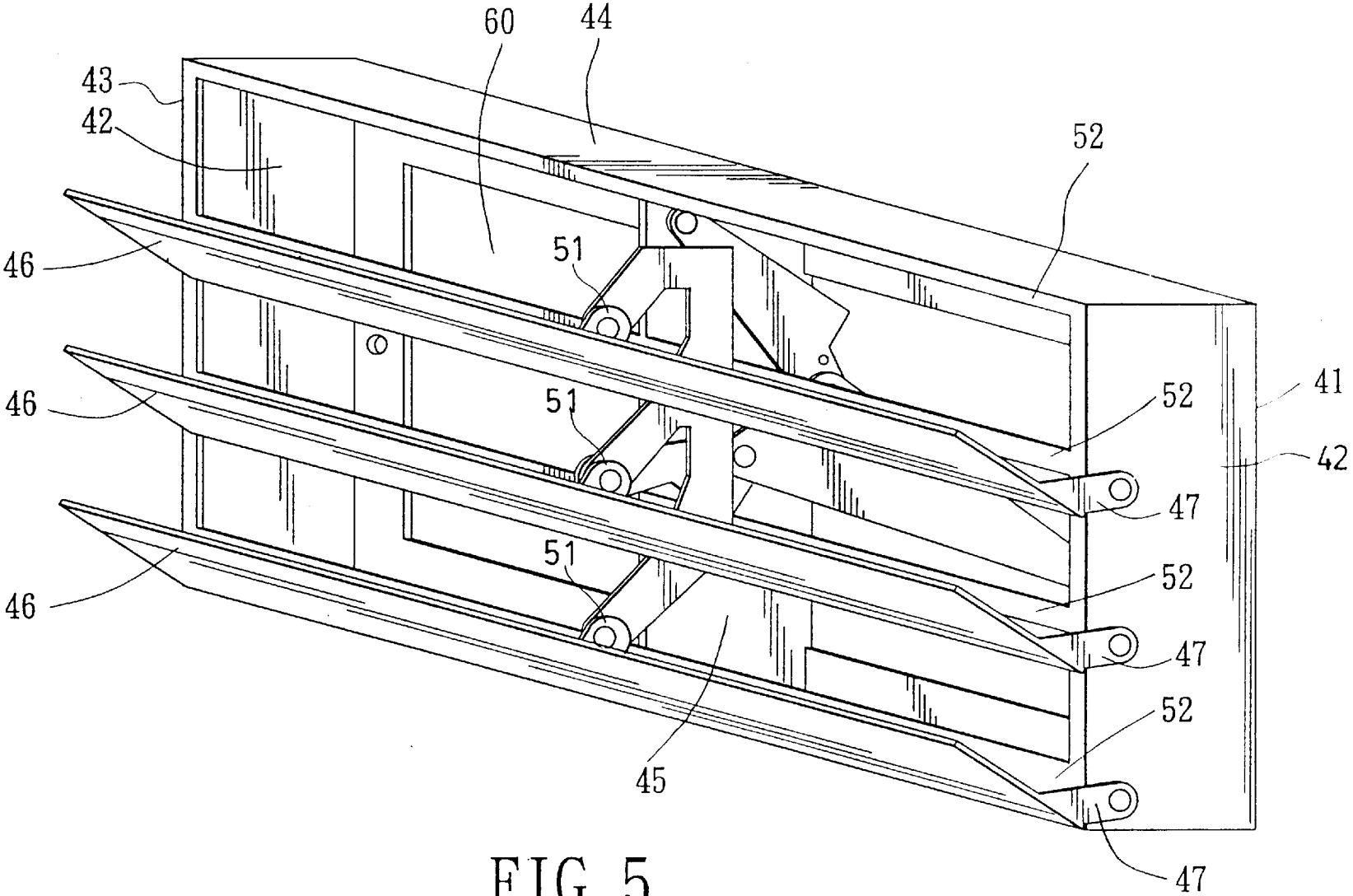
FIG. 5 is a rear perspective view of the adjustable register of FIG. 4.

Referring to FIGS. 4 and 5, a preferred embodiment of an adjustable register of this invention includes a generally rectangular hollow frame member 40 having an air passage 60 extending between the front side 41 and the rear side 43 thereof, a plurality of elongated slats 46 connected pivotally to the frame 40, a slat connecting member 48 connected pivotally to each of the slats 46, a toggle-joint mechanism 50, and a plurality of blocking bars 52 disposed on the rear end 43 of the frame 40.

Tire frame member 40 has opposite lateral frame portions 42 that extend uprightly, opposite transverse frame portions 44 that bridge the lateral frame portions 42 and that extend horizontally, and a mounting plate 45 mounted securely on and extending between the transverse frame portions 44 of the frame member 40 inside the air passage 60. In the preferred embodiment, the mounting plate 45 is disposed midway of the transverse frame portions 44. The mounting plate 45 has major surfaces extending between the front side 41 and the rear side 43 of the frame member 40.

The toggle-joint mechanism 50, including an operating lever 54 and a retaining linkage 56, is mounted pivotally on one of the major surfaces of the mounting plate 45 of the frame member 40. The toggle-joint mechanism 50 is connected pivotally to the slat connecting member 48 through a slat controlling linkage 58 which is mounted pivotally on the same major surface of the mounting plate 45.

A louvered register face panel 53 is mounted on the front side 41 of the frame member 40. The louvered register face panel 53 has an operating slot 49 disposed to be aligned with the operating lever 54 of the toggle-joint mechanism 50, thereby allowing the operating lever 54 to extend forwardly therethrough.

Each of the elongated slats 46 extends parallel to the transverse frame portions 44 and is disposed outwardly of the air passage 60 behind the blocking bars 52. Each of the slats 46 has opposite ends formed with a pivot arm 47 for mounting pivotally on the lateral frame portions 42 of the frame member 40. The slats 46 pivot about a respective horizontal axis between an open position where the slats 46 permit airflow through the air passage 60, and a closed position where the slats 46 block air flow through the air passage 60. Each of the slats 46 has a pivot portion 51 extending from one of the major surfaces thereof and adjacent to the slat connecting member 48 for connecting pivotally therewith.

A plurality of elongated blocking bars 52 extend between the lateral frame portions 42 parallel to the transverse frame portions 44 and are disposed adjacent to the rear side 43 of the frame 40. The blocking bars 52 are so disposed as to abut against longitudinal edges of the slats 46 when the slats 46 are in the closed position to block clearances formed between endmost ones of the slats 46 and the transverse frame portions 44 of the frame member 40 and between the longitudinal edges of adjacent ones of the slats 46

Figure 6:
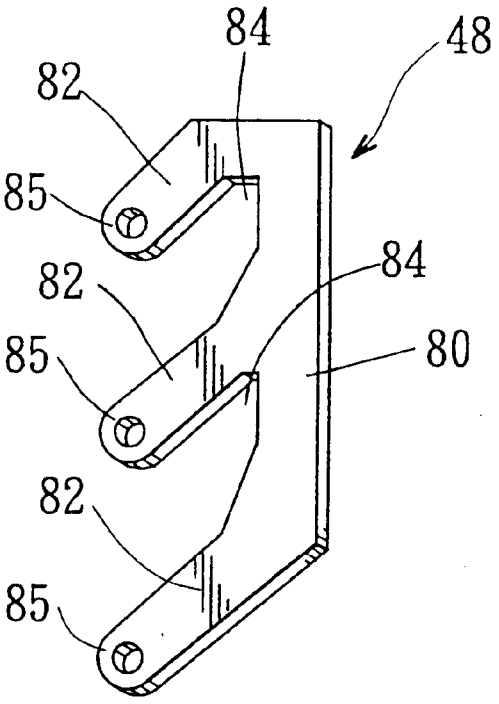
FIG. 6 is a perspective view of the slat-connecting member.

As clearly shown in FIG. 6, the slat connecting member 48 has an upright trunk portion 80 and a plurality of branch portions 82, each of which extends rearwardly and downwardly from the trunk portion 80 and has a distal end 85 connected pivotally to the pivot portion 51 of the respective one of the slats 46. In this illustrated embodiment where three slats 46 are illustrated, the shape of the slat connecting member 48 is like a reverse "E." It is appreciable that the shape of the slat connecting member 48 varies with the number of the slats 46 to be connected. That is, for a larger-sized register with more slats, the shape of the connecting member 48 is like a reverse, multiple-overlapping "E." The number of the branch portions 82 depends on the number of the slats 46 to be connected. Each of the branch portions 82 cooperates with the trunk portion 80 to form a downwardly opening bar receiving notch 84 for extension of a respective one of the blocking bars 52 therein, thereby preventing the blocking bars 52 from hindering movement of the slats 46 between the open and closed positions. The branch portions 82 extend outwardly of the air passage 60 at the rear side 43 of the frame member 40 when the slats 46 are in the open position, and are retracted into the air passage 60 when the slats 46 are in the closed position.

Figure 7:
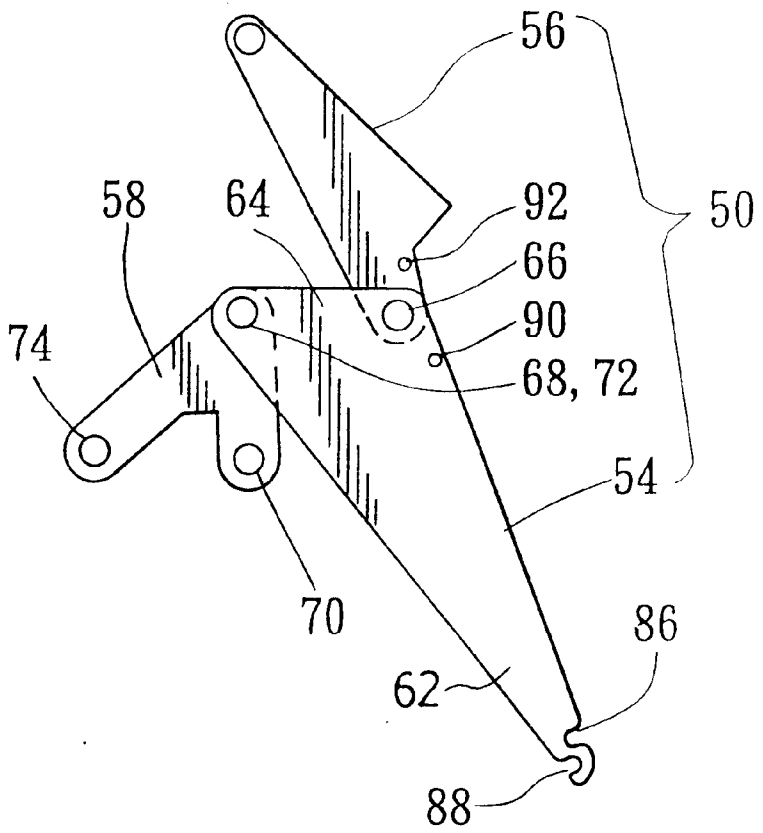
FIG. 7 is an enlarged schematic view of the toggle-joint mechanism in cooperation with the slat-controlling linkage.

Referring to FIG. 7 in conjunction with FIG. 5, the interconnections among the mounting plate 45, the toggle-joint mechanism 50, the slat-controlling linkage 58, and the slats 46 will now be described in detail.

The operating lever 54 has an operating end portion 62 and a mounting end portion 64 opposite to the operating end portion 62. The operating end portion 62 extends outwardly of the air passage 60 at the front side 41 of the frame member 40 through the operating slot 49 of the louvered register face panel 53. The mounting end portion 64 of the operating lever 54 is connected movably to the frame member 40 through the retaining linkage 56. The retaining linkage 56 and the operating lever 54 are connected pivotally at a first pivot section 66 which is movable and about which the operating lever 54 can pivot. The mounting end portion 64 of the operating lever 54 further has a second pivot section 68 for connecting pivotally to the slat controlling linkage 58. The second pivot section 68 is disposed remote from the operating end portion 62 relative to the first pivot section 66.

The slat controlling linkage 58, substantially of a V-shape in FIG. 7, has a first pivot portion 70 mounted pivotally on the mounting plate 45 of the frame member 40, a second pivot portion 72 mounted pivotally together with the second pivot section 68 of the operating lever 54, and a third pivot portion 74 connected pivotally to one of the slats 46. The connection between the slat-controlling linkage 58 and the driven one of the slats 46 is in a manner similar to that for the connection of the slat connecting linkage 48 and the slats 46, or by any other conventional means.

The first, second, and third pivot portions 70, 72, 74 of the slat controlling linkage 58 are disposed along a V-shaped line with the second pivot portion 72 located between the first and third pivot portions 70 and 74. The ends of the retaining linkage 56, the first and second pivot sections 66 and 68 of the operating lever 54, and the first, second, and third pivot portions 70, 72, 74 of the slat controlling linkage 58 all pivot about horizontal axes.

Hereinafter describes the movement of the slats 46 along with the slat controlling linkage 58 and the toggle-joint mechanism 50.

Figure 8B:
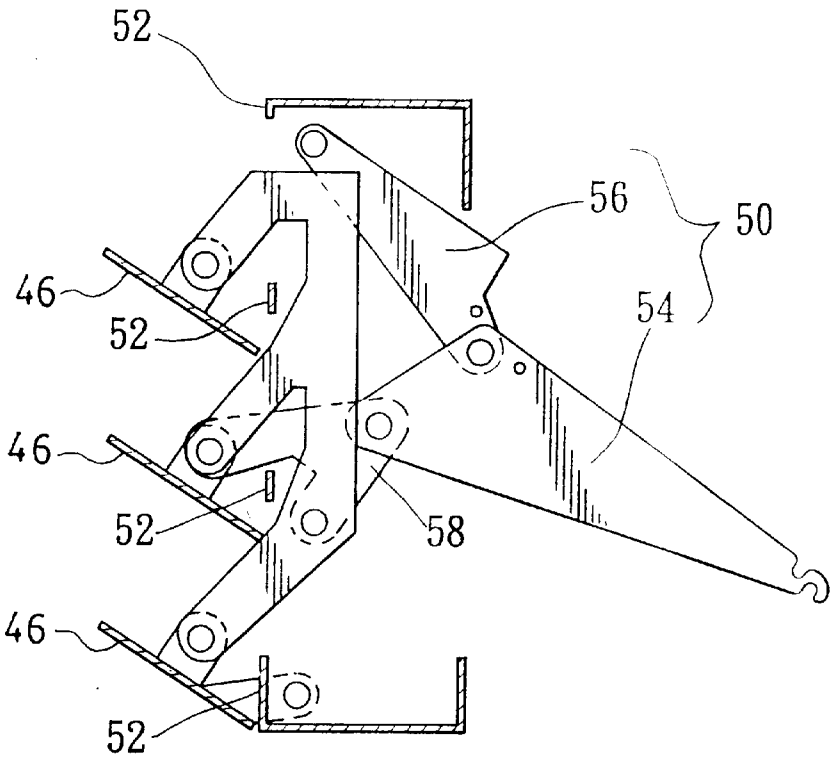
FIGS. 8*a* to 8*f* show a series of consecutive operation of the adjustable register, where the slats are moved from an open position through a closed position to a pressing position.
Figure 8A:
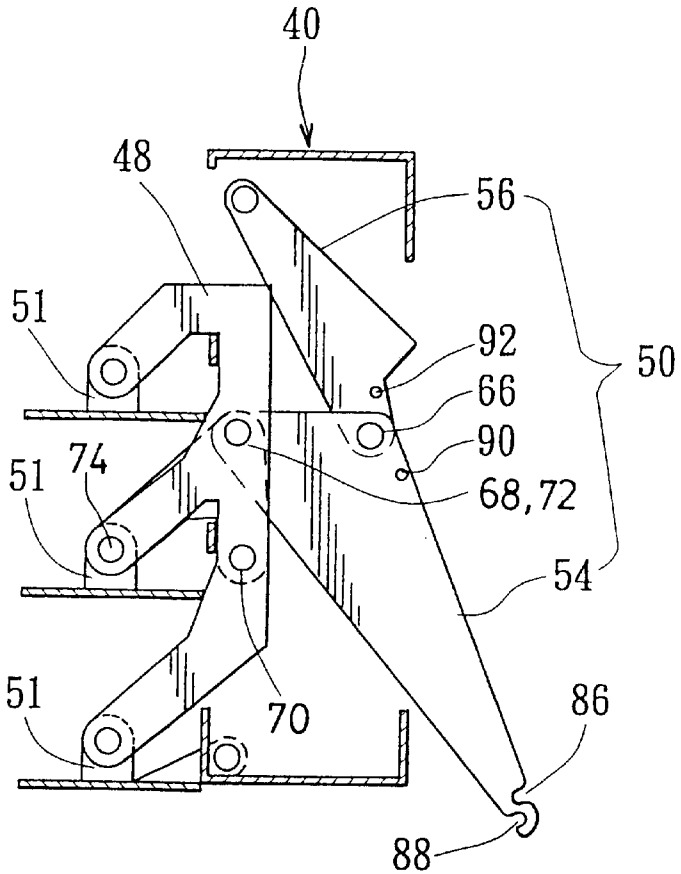
Figure 8D:
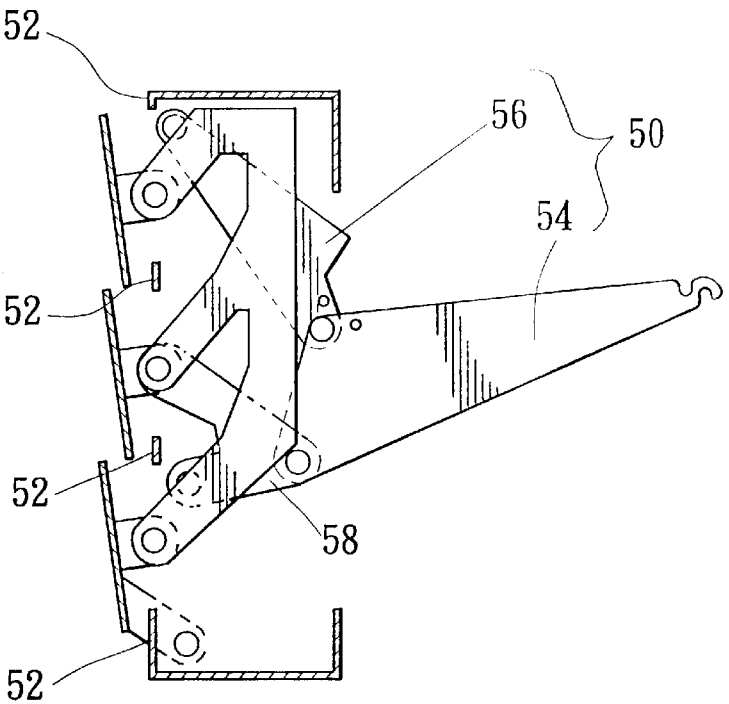
Figure 8C:
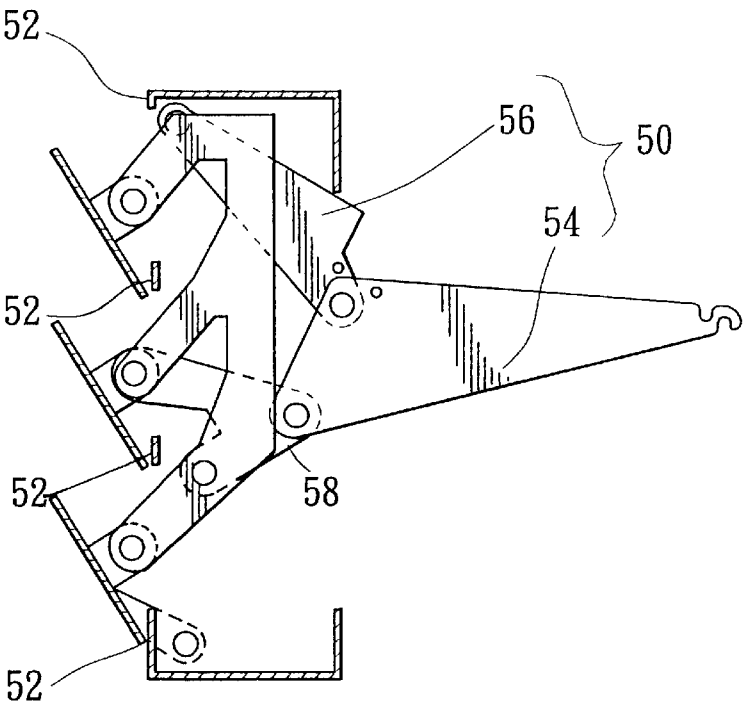
Figure 8F:
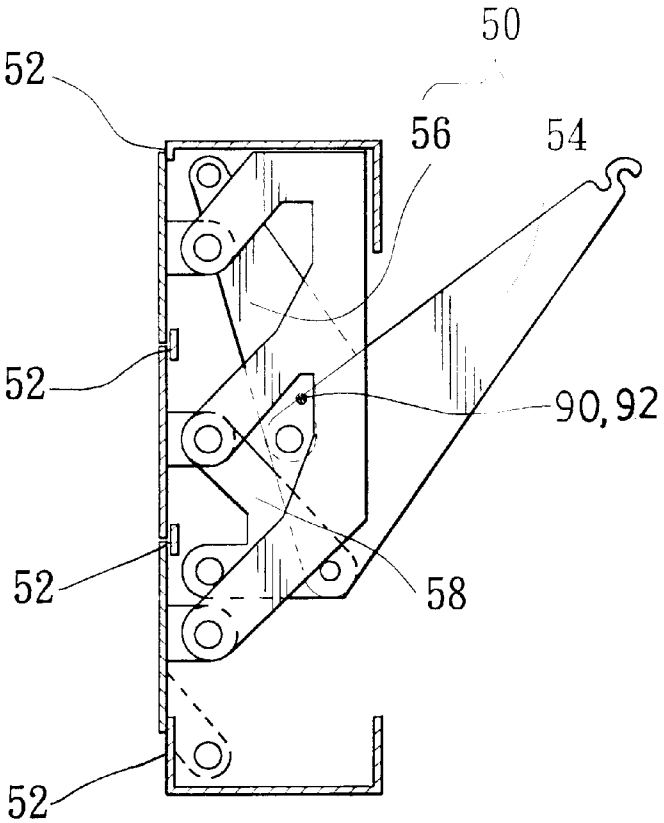
Figure 8E:
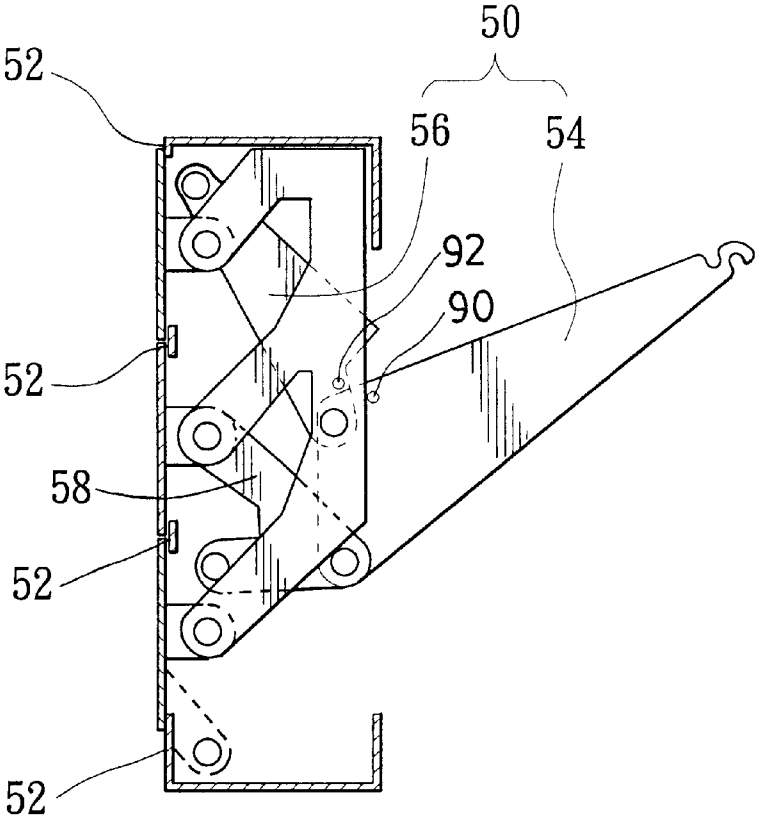
Figure 9B:
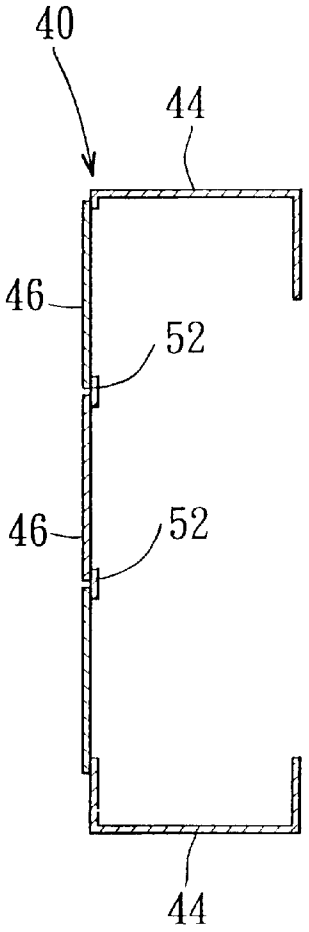
FIG. 9*b* is a cross-sectional view of the register taken along line A—A of FIG. 9*a*, where the front louvered register face panel is removed therefrom for clarity.
Figure 9A:
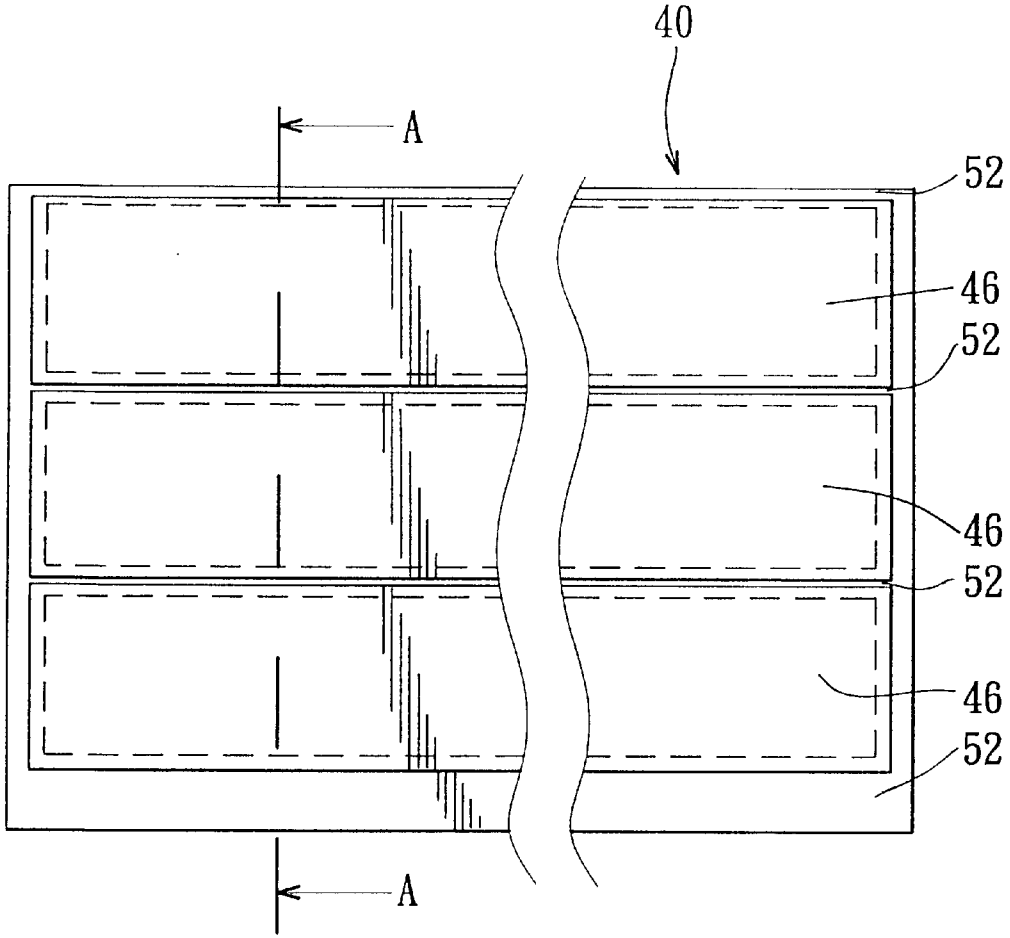
FIG. 9*a* is a rear plan view of the adjustable register of FIG. 4 in the closed position, with the front louvered register face panel removed.

Referring to FIGS. 8*a* to 8*f* in conjunction with FIG. 7, when the operating end 62 of the operating lever 54 is operated to rotate counterclockwise about the first pivot section 66, the second pivot section 68 is moved accordingly about the first pivot section 66, thus causing the slat controlling linkage 58 to rotate about the first pivot portion 70. Since the third pivot portion 74 of the slat controlling linkage 58 is connected pivotally to one of the slats 46, the driven one of the slats 46 moves to result in corresponding movement of the other ones of the slats 46 about their respective horizontal axis. As shown in FIG. 8*a*, when the operating lever 54 is in an initial state, the slats 46 are in a position substantially perpendicular to the blocking bars 52. When the operating lever 54 pivots counterclockwise about the first pivot section 66, as shown in FIGS. 8*a* to 8*e*, the angles defined by the slats 46 and the adjacent one of the blocking bars 52 decrease until the slats 46 reach the closed position. Referring to FIGS. 8*e*, 9*a*, and 9*b*, when in the closed position, the slats 46 make close contact with the blocking bars 52 to ensure air-tight performance.

The confronting surfaces of the operating lever 54 and the retaining linkage 56 are formed respectively with a projection 90 and a complementary recess 92. The projection 90 and the complementary recess 92 are disposed so that when the closed position has been reached, the operating lever 54 is further moved toward the retaining linkage 56 until the projection 90 and the complementary recess 92 releasable engage each other, as shown in FIG. 8*f*. With the engagement between the projection 90 and the complementary recess 92, a pressing force is generated between the blocking bars 52 and the slats 46 to secure the air-tight effect.

To further enhance the air-tight effect, the blocking bars 52 may be provided with a cushioning layer, such as felt or thermally stable rubber, on the contacting surfaces thereof.

Although the projection 90 and the complementary recess 92 has been described to be formed in the operating lever 54 and the retaining linkage 56, respectively, it can be appreciated that the disposition of the projection 90 and the complementary recess 92 may be reversed to achieve the same function. Further, it is within the contemplation of this invention that any other kind of engaging mechanism can be adopted for generating a persistent pressing force between the slats 46 and the blocking bars 52 to enhance the air-tight effect.

Though the first pivot section 66 of the operating lever 54 has been described to be connected pivotally to the retaining linkage 56 and movable relative to the mounting plate 45 of the frame member 40, alternatively, it is possible to perform the same function by connecting pivotally the first pivot section 66 of the operating lever 54 directly to the mounting plate 45 of the frame member 40. In this case, the retaining linkage 56 can be eliminated if an additional pressing force is not required.

In addition to the air-tight effect, the adjustable register of this invention possesses an additional advantage in terms of operation. In the conventional adjustable register, the operating lever for controlling the slats extends slightly from the front panel for aesthetic purpose. Where the adjustable register is installed so high as for those high ceiling buildings, and to be out of arm's reach, it is not possible to use a stick or other height adjusting tool to help in reaching the lever. Thus, a supporting means, such as a chair, table, or ladder, is required to make the manual operating of the lever possible, thereby imposing inconvenience to the user.

Figure 10:
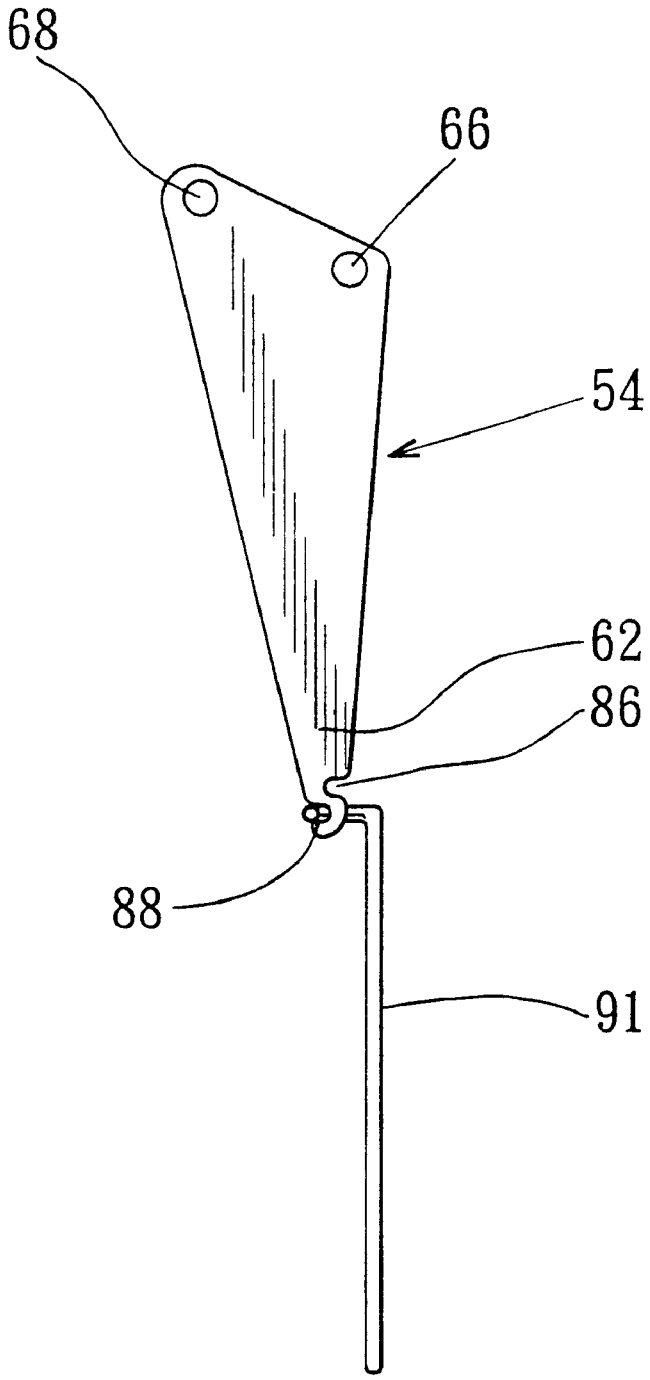
FIG. 10 is a perspective view showing the operating lever of the toggle-joint mechanism and an operating stick.

Referring to FIG. 10, the operating end portion 62 of the operating lever 54 of this invention is formed with an upper notch 86 and a lower notch 88. The user may use an operating stick 91 to anchor on the upper notch 86 or the lower notch 88 to facilitate the operation of the lever 54 when the lever 54 is inaccessible directly to the user. As a result, the present register is easy to operate and will not cause any trouble or inconvenience to the user.

Furthermore, the adjustable register of this invention works amazingly and satisfactorily when used together with the HVAC system proposed in U.S. Pat. No. 5,833,134, entitled "Wireless Remote Temperature Sensing Thermostat with Adjustable Register," issued on Nov. 10, 1998 to the present Applicant. The register disclosed in the '134 patent has a roll-up metal foil shutter in the back of the grill of the air-duct register so that the air flow therethrough can be easily controlled. While the mechanism for blocking airflow in the '134 patent is of a roll-up shutter type, which is different from the toggle-joint mechanism of this invention, the register in the '134 patent can be easily replaced by the present register which adapts well with HVAC system of the '134 patent to provide ideal air-tight performance.

It is understandable that the above description is intended to be illustrative and not restrictive. A variety of modifications will be apparent to those skilled in the art within the sprit and scope of the invention as defined in the appended claims.

We claim:

1. A register, comprising:

a hollow frame member including opposite lateral frame portions and opposite transverse frame portions that bridge said lateral frame portions, said frame member having open front and rear sides, and an air passage extending from said rear side through said front side;

a plurality of elongated slats, each of which has opposite ends mounted pivotally and respectively on said lateral frame portions of said frame member, said slats being movable between an open position, where said slats permit airflow through said air passage, and a closed position, where said slats block airflow through said air passage;

a slat connecting member connected pivotally to each of said slats such that movement of a driven one of said slats results in corresponding movement of other ones of said slats between the open and closed positions;

a plurality of elongated blocking bars mounted securely on and extending between said lateral frame portions of said frame member, said blocking bars being disposed so as to abut against longitudinal edges of said slats when said slats are in the closed position to block clearances formed between endmost ones of said slats and said transverse frame portions of said frame member and between said longitudinal edges of adjacent ones of said slats;

an operating lever having an operating end portion and a mounting end portion opposite to said operating end portion and connected movably to said frame member; and a slat controlling linkage connected pivotally to said mounting end portion of said operating lever, and further connected to said driven one of said slats;

said operating end portion of said operating lever being operable to move said operating lever and said slat controlling linkage, thereby moving said driven one of said slats to result in the corresponding movement of the other ones of said slats between the open and closed positions.

2. The register as claimed in claim 1, further comprising a retaining linkage having one end connected pivotally to said frame member, and an opposite end connected pivotally to said mounting end portion of said operating lever, said retaining linkage and said operating lever cooperatively forming a toggle-joint mechanism.

3. The register as claimed in claim 2, wherein:

said mounting end portion of said operating lever has a first pivot section connected pivotally to said opposite end of said retaining linkage, and a second pivot section; and said slat controlling linkage has a first pivot portion mounted pivotally on said frame member, a second pivot portion mounted pivotally together with said second pivot section of said mounting end portion of said operating lever, and a third pivot portion connected pivotally to said driven one of said slats.

4. The register as claimed in claim 3, wherein said blocking bars are disposed adjacent to said rear side of said frame member, each of said slats being disposed outwardly of said air passage behind said blocking bars and being formed with a pair of pivot arms for mounting pivotally on said lateral frame portions of said frame member.

5. The register as claimed in claim 4, wherein said frame member further has a mounting plate mounted securely on and extending between said transverse frame portions of said frame member inside said air passage, said mounting plate having major surfaces that extend between said front and rear sides of said frame member, said one end of said retaining linkage and said first pivot portion of said slat controlling linkage being mounted pivotally on said mounting plate.

6. The register as claimed in claim 5, wherein said operating lever, said retaining linkage and said slat controlling linkage are disposed adjacent to one of said major surfaces of said mounting plate.

7. The register as claimed in claim 5, wherein said first pivot section of said operating lever is disposed proximately to said operating end thereof relative to said second pivot section thereof, and said first, second and third pivot portions of said slat controlling linkage are disposed along a V-shaped line with said second pivot portion being located between said first and third pivot portions.

8. The register as claimed in claim 5, wherein said lateral frame portions extend uprightly, and said transverse frame portions extend horizontally.

9. The register as claimed in claim 8, wherein said frame member is generally rectangular.

10. The register as claimed in claim 8, wherein said slats and said blocking bars extend parallel to said transverse frame portions.

11. The register as claimed in claim 8, wherein said slats pivot about a respective horizontal axis.

12. The register as claimed in claim 9, wherein said ends of said retaining linkage, said first and second pivot sections of said operating lever, and said first, second and third pivot portions of said slat controlling linkage pivot about horizontal axes.

13. The register as claimed in claim 5, wherein said operating end of said operating lever extends outwardly of said air passage at said front side of said frame member.

14. The register as claimed in claim 13, wherein said mounting plate is disposed midway of said transverse frame portions.

15. The register as claimed in claim 14, further comprising a louvered register face panel mounted on said front side of said frame member and formed with an operating slot to permit extension of said operating end of said operating lever therethrough.

16. The register as claimed in claim 10, wherein said slat connecting member has an upright trunk portion and a plurality of branch portions, each of which extends rearwardly and downwardly from said trunk portion and is connected pivotally to the respective one of said slats.

17. The register as claimed in claim 16, wherein each of said branch portions cooperates with said trunk portion to form a downwardly opening bar receiving notch for extension of a respective one of said blocking bars therein, thereby preventing said blocking bars from hindering movement of said slats between the open and closed positions.

18. The register as claimed in claim 17, wherein said branch portions extend outwardly of said air passage at said rear side of said frame member when said slats are in the open position, and are retracted into said air passage when said slats are in the closed position.

19. The register as claimed in claim 2, further comprising retaining means provided on said operating lever and said retaining linkage for releasable engagement therebetween when said slats are in the closed position.

20. The register as claimed in claim 19, wherein said retaining means includes a projection provided on one of said operating lever and said retaining linkage, and a complementary recess formed on the other one of said operating lever and said retaining linkage for releasable engagement with said projection.

21. The register as claimed in claim 1, wherein each of said blocking bars has a slat contacting surface provided with a cushioning layer to contact said slats and establish an airtight seal therewith when said slats are in the closed position.

* * * * *